US006305337B1

(12) United States Patent
Sumi et al.

(10) Patent No.: US 6,305,337 B1
(45) Date of Patent: Oct. 23, 2001

(54) OVERHEAD CAM SHAFT TYPE ENGINE WITH A STARTER MOTOR

(75) Inventors: Hiromi Sumi; Atsushi Sawa, both of Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/518,253

(22) Filed: Mar. 3, 2000

(30) Foreign Application Priority Data

Mar. 4, 1999 (JP) ..... 11-056865

(51) Int. Cl.[7] ..... F02N 11/00
(52) U.S. Cl. ..... 123/179.25
(58) Field of Search ..... 123/54.4, 198 R, 123/196 R, 196 A, 179.25, 90.31

(56) References Cited

U.S. PATENT DOCUMENTS 4,848,170 * 7/1989 Inagaki et al. ..... 123/179.25
4,960,081 * 10/1990 Atsuumi ..... 123/195 C
5,857,442 * 1/1999 Sumi ..... 123/196 R

FOREIGN PATENT DOCUMENTS 10-141039 5/1998 (JP) .

* cited by examiner

*Primary Examiner*—Tony M. Argenbright
*Assistant Examiner*—Hyder Ali

(57) ABSTRACT

In an overhead cam shaft engine with a starter motor, the starter motor is to be mounted to a front face of a crank case at a position close to a cylinder, thereby creating a space on the front face of the crank case, while preventing interference between a gear train for the transfer of rotation of the starter motor and a cam shaft driving mechanism. An overhead cam shaft type engine includes a starter motor, having a cam shaft driving mechanism disposed on one end side of a crank shaft and a gear train for the transfer of rotation of a starter motor. The gear train is disposed on an opposite side of the crank shaft. The axis of a gear shaft of at least one gear of plural gears which constitute the gear train is positioned above a crank case dividing plane. Furthermore, the starter motor is mounted to a front face of a lower crank case at an upper position close to a cylinder, and an oil filter is mounted in a space thus created below the starter motor on the front face of the lower crank case.

12 Claims, 7 Drawing Sheets

OVERHEAD CAM SHAFT TYPE ENGINE WITH A STARTER MOTOR

BACKGROUND OF THE INVENTION

1. Field of the Invention

The present invention relates to an overhead cam shaft type engine for being installed on a vehicle such as a motorcycle, with a starter motor being attached to a surface of a crank case thereof.

2. Description of Related Art

An overhead cam shaft V-type engine mounted on a motorcycle and having a cam shaft provided in a cylinder head has been known, wherein a starter motor and an oil filter are attached respectively to a front face of a crank case and a front face of an oil pan (see Japanese Published Unexamined Patent Application No. Hei 10-141039).

The above conventional overhead cam type engine is mounted horizontally on a vehicle so that a crank shaft extends in the transverse direction. In the mounted state of the engine, a front cylinder of a front bank is inclined forward and a rear cylinder of a rear bank is inclined backward. A cylinder head is mounted to each of the front and rear cylinders, and an intake cam shaft and an exhaust cam shaft for actuating an intake valve and an exhaust valve through a valve operating mechanism are mounted in the cylinder head. Cam sprockets are mounted respectively on left end portions of the intake and exhaust cam shafts in the front cylinder. Furthermore, a cam shaft driving chain is stretched between the cam sprockets and a driving sprocket mounted on a left end portion of the crank shaft while being entrained on those sprockets, whereby the rotation of the crank shaft is transmitted to both of the cam shafts. Cam sprockets are also mounted on right end portions of the intake and exhaust cam shafts in the rear cylinder. Furthermore, a cam shaft driving chain is stretched between the cam sprockets and a driving sprocket mounted on a right end portion of the crank shaft while being entrained on those sprockets, whereby the rotation of the crank shaft is transmitted to both of the cam shafts.

On the left end portion of the crank shaft are mounted an AC generator and a starter driven gear which is positioned adjacent the AC generator. A starter motor is attached to the front face of the crank case. Upon start-up of the engine, the rotation of the starter motor is transmitted to the crank shaft via a gear train which comprises a pinion gear and a reduction gear and through the starter driven gear mounted on the crank shaft.

In the conventional art referred to above, since the driving sprocket, cam shaft driving chain and cam sprockets, which constitute the cam shaft driving mechanism in the front cylinder, the cam shaft driving mechanism and the gear train are provided on the left end portion of the crank shaft. In this case, since it is necessary to avoid interference of both the cam shaft driving mechanism and the gear train, it has so far been difficult to mount the starter motor at an upper position of the front face of the crank case. Therefore, in the conventional art being considered, it is inevitably required that an oil filter, which is also mounted in front of the engine like the starter motor, be attached to the front face of the oil pan mounted to a lower portion of the crank case. This restricts, for example, the arrangement of an exhaust pipe extending from the front cylinder.

SUMMARY OF THE INVENTION

The present invention has been accomplished in view of such circumstances, and it is an object of a first aspect of the present invention to eliminate interference of both the gear train and the cam shaft driving mechanism. Furthermore, it is an object of the first aspect of the present invention to mount the starter motor to the surface of the crank case while it is drawn as close as possible to the cylinder, thereby creating a space on the surface of the crank case.

According to a second aspect of the present invention, the first aspect of the present invention is applied to an engine, wherein a crank case has a dividing plane passing through a crank shaft axis.

According to a third aspect of the present invention, the first aspect of the present invention is applied to an engine, wherein a crank case is divided vertically by a dividing plane passing through a crank shaft axis to attain a compact size of the crank case.

According to a fourth aspect of the present invention, it is an object to increase the degree of freedom in the arrangement of components attached to the engine.

According to a fifth aspect of the present invention, it is an object to simplify the structure of an oil passage and reduce the size of an oil pan.

According to a sixth aspect of the present invention, it is an object to increase the degree of freedom in the arrangement of an exhaust pipe.

According to a seventh aspect of the present invention, it is an object to apply the first through sixth aspects of the present invention to a V-type 2-cylinder engine.

In the present case, the first aspect of the present invention is an overhead cam shaft type engine with a starter motor, comprising a cylinder, a cam shaft provided in a cylinder head mounted to the cylinder, a cam shaft driving mechanism disposed on one end side of the crank shaft to transmit the rotation of the crank shaft to the cam shaft, and a gear train disposed on an opposite end side of the crank shaft to transmit the rotation of the starter motor to the crank shaft, wherein the starter motor is attached to a surface of a crank case, a gear shaft axis of at least one of plural gears which constitute the gear train is disposed on a side of a plane including a crank shaft axis on which side a cylinder axis of the cylinder is positioned, and an included angle between a planar portion extending toward the gear train from the crank shaft axis in the above plane and the cylinder axis is an acute angle.

Thus, according to the first aspect of the present invention, the starter motor is attached to the surface of the crank case and an included angle between the planar portion extending toward the gear train and the cylinder axis is an acute angle. Therefore, despite the cylinder being positioned close to the starter motor, the gear train is disposed on the opposite end side of the crank shaft opposite to the one end side of the crank shaft where the cam shaft driving mechanism is disposed.

Therefore, without interference with the cam shaft driving mechanism, a gear shaft axis of at least one of plural gears which constitute the gear train can be disposed closer to the cylinder with respect to the aforesaid plane. As a result, it also becomes possible for the starter motor to be attached to the surface of the crank case at a position close to the cylinder, so that a space is created on the crank case surface, which space can be utilized for the mounting of components.

According to the second aspect of the present invention, an overhead cam shaft type engine with a starter motor is provided, wherein the crank case is divided into two crank cases by a dividing plane. The dividing plane, including the crank shaft axis, is the dividing plane. More specifically, the crank case is divided by the dividing plane into a crank case where a cylinder is provided and a crank case where a cylinder is not provided. A gear shaft axis of at least one of plural gears which constitute the gear train can be disposed in the crank case where a cylinder is provided. Consequently, in proximity to the surface of the crank case, the starter motor can be mounted to the surface of the crank case where a cylinder is not provided, or it can be mounted to the surface of the crank case where a cylinder is provided. As a result, it becomes possible to dispose the starter motor in proximity to the cylinder, thus permitting a space to be created on the surface of the crank case where a cylinder is not provided.

According to the third aspect of the present invention, an overhead cam shaft type engine with a starter motor is provided, wherein the crank case is divided vertically into an upper crank case and a lower crank case by a dividing plane. The crank shaft is supported by the upper crank case and the lower crank case, and the foregoing plane including the crank shaft axis is the dividing plane. Furthermore, a gear shaft axis (axes) of a portion of plural gears which constitute the gear train is (are) disposed on an upper side of the dividing plane on which side the cylinder axis is positioned. A gear shaft axis (axes) of the remaining gear (gears) is (are) disposed on a lower side of the dividing plane. Therefore, a gear shaft axis of at least one of plural gears which constitute the gear train can be disposed in the upper crank case positioned above the dividing plane, so that the starter motor can be attached to the surface of the lower crank case in proximity to the upper crank case, or to the surface of the upper crank case. As a result, it becomes possible to mount the starter motor in proximity to the cylinder and hence a space can be created on the surface of the lower crank case.

Furthermore, since plural gears which constitute the gear train on both sides of the dividing plane can be arranged dispersedly, in the upper and lower crank cases, the gear train can be disposed without enlarging the spacing between the starter motor and the crank shaft, thus permitting the crank case to be formed compactly.

According to the fourth aspect of the present invention, an overhead cam shaft type engine with a starter motor is provided, wherein an oil filter is attached to the surface of the crank case at a position below the starter motor. According to this configuration, an oil filter can be installed in a space created on the surface of the crank case; namely, a space formed below the starter motor. Consequently, the degree of freedom in the arrangement of components located around the conventional position of the oil filter increases.

According to the fifth aspect of the present invention, an overhead cam shaft type engine is provided, wherein the crank case is divided into an upper crank case and a lower crank case by a dividing plane, an oil pan is attached to a lower portion of the lower crank case, an oil pump is attached to the lower crank case, and the starter motor and the oil filter are attached to a surface of the lower crank case. Thus, since the starter motor and the oil filter are attached to the surface of the lower crank case to which the oil pump is mounted, it becomes possible to feed oil from the oil pump to the oil filter under pressure through an oil passage formed in only the lower crank case. The structure of the oil passage is thereby simplified and the formation thereof becomes easy, thus permitting reduction of cost. In addition, unlike the conventional art, it is not necessary to form an oil passage in the oil pan and therefore it is possible to attain a reduction in size of the oil pan.

According to the sixth aspect of the present invention, an overhead cam shaft type engine with a starter motor is provided, wherein an exhaust pipe connected to the cylinder is laid along a side face of the oil pan. Unlike the conventional art, the oil filter does not project to a front face of the oil pan, so the degree of freedom in the arrangement of an exhaust pipe such as a more compact arrangement or an arrangement based mainly on its performance is increased by utilizing a space created around the oil pan. I According to the seventh aspect of the present invention, an overhead cam shaft type engine with a starter motor is provided, wherein the engine is a V-type 2-cylinder engine for being installed horizontally on a vehicle, and the cylinder belongs to a front bank. According to this configuration, the effect of the invention defined in any of the first through sixth aspects of the present invention can be exhibited more effectively particularly in a V-type 2-cylinder engine wherein the width in the crank shaft axis direction is narrow.

The "included angle" as referred to herein between a planar (or dividing plane) portion extending from the crank shaft axis in a plane (or dividing plane) including the crank shaft axis toward the gear train means an angle between an intersecting line and the cylinder axis, the intersecting line being a line of intersection between a plane including the cylinder axis and intersecting perpendicularly to the above planar (or dividing plane) portion and the planar (or dividing plane) portion. In other words, the "included angle" is an angle between the cylinder axis and a line in the same plane as the cylinder axis and the planar portion.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

An embodiment of the present invention will now be described with reference to FIGS. 1 to 7. In the description, of the embodiment, up, down, front, rear, right, and left indicate the respective directions with respect to a vehicle concerned.

An overhead cam shaft type engine according to an embodiment of the present invention is illustrated in FIGS. 1 to 7. This engine, indicated at 1, is an overhead cam shaft type V-shaped 2-cylinder engine with a starter motor which is to be mounted on a motorcycle.

Figure 1:
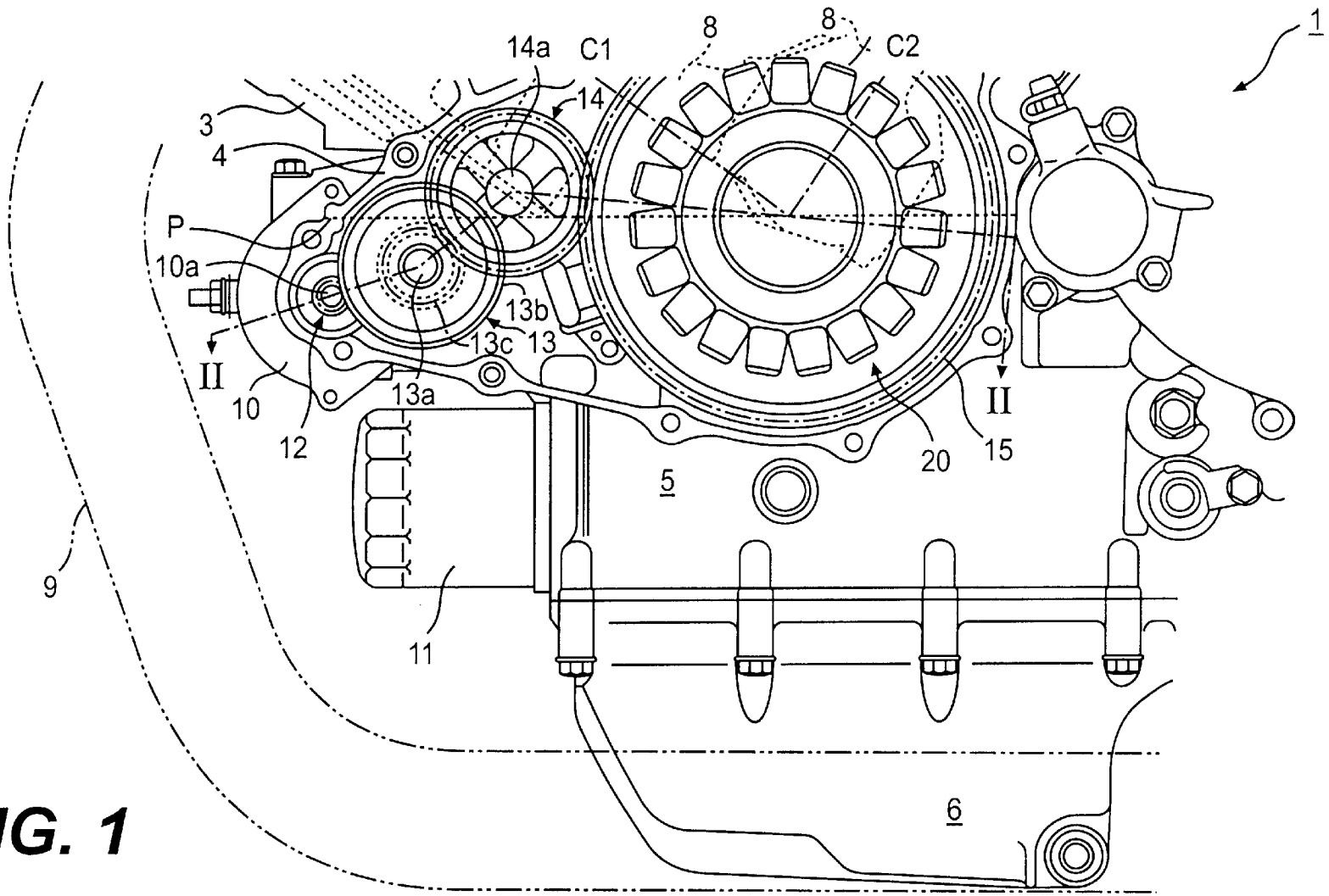
FIG. 1 is a left side view of an overhead cam shaft type 2-cylinder engine with a starter motor according to an embodiment of the present invention.

The engine 1 is mounted on the vehicle horizontally so that a crank shaft 2 extends in the transverse direction of the vehicle. With the engine thus mounted, a front cylinder 3 which constitutes a front bank is inclined forward of the vehicle, while a rear cylinder which constitutes a rear bank is inclined rearward of the vehicle. As shown in FIG. 1, which is a left side view of a crank case in the engine 1 (with a crank case cover 7 removed) and FIG. 3, which is a right side view of the crank case (with the crank case cover 7 removed), an inclination angle of a cylinder axis C1 of the front cylinder 3 relative to the vertical direction is set larger than a cylinder axis C2 of the rear cylinder, the angle between both cylinder axes C1 and C2 being about 90°.

The crank case is a vertically divided type and is divided into an upper crank case 4 and a lower crank case 5 by a dividing plane P. The dividing plane P includes a crank shaft axis L1 and an axis of a main shaft in a gear transmission. The front cylinder 3 and the rear cylinder are provided in the upper crank case 4 and an oil pan 6 is attached to a lower portion of the lower crank case 5.

The crank shaft 2 is supported at right and left crank journals 2*a* thereof by the upper and lower crank cases 4, 5 through two right and left metals serving as main bearings Furthermore, connecting rods 8 are respectively connected at first ends thereof to crank pins 2*b* and at second, opposite ends thereof to piston pins of pistons which reciprocate within the front cylinder 3 and the rear cylinder, respectively.

Figure 4:
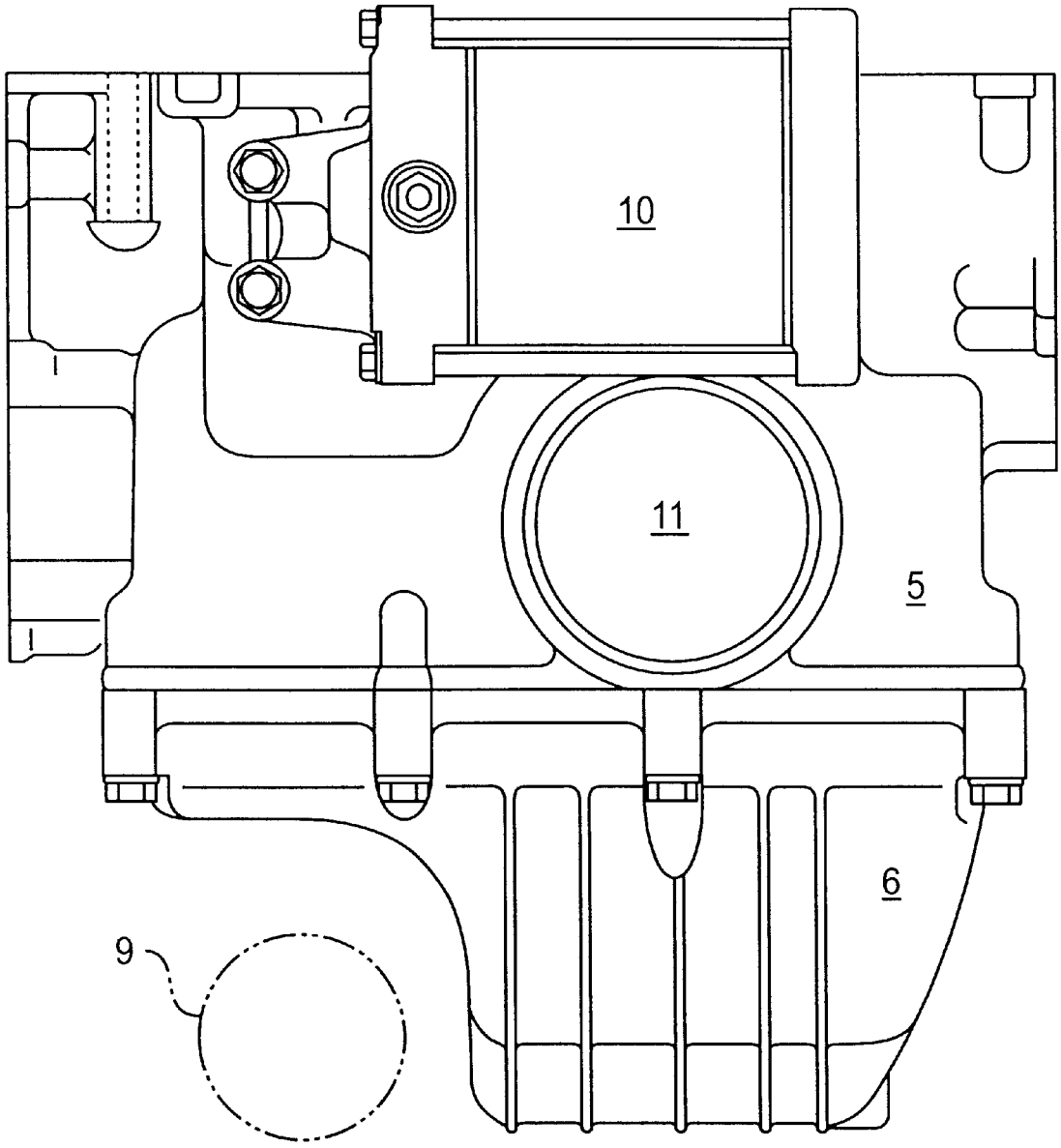
FIG. 4 is a front view of a lower crank case and an oil pan in the engine shown in FIG. II.

FIG. 4 is a front view of the lower crank case 5 in the engine 1 and the oil pan 6. As shown in this figure, a starter motor 10 is attached to a front face of the lower crank case 5. The front face is a part of a surface of the lower crank case 5, at an upper position with respect to a vertically central position of the front face. An oil filter 11 is attached to the same front face at a lower position with respect to the central position. The starter motor 10 is fixed so that a shaft 10*a* thereof is parallel to the crank shaft 2 and a left end portion thereof is inserted into a hole formed in the lower crank case 5 in such a manner that a pinion gear 12 mounted on the shaft 10*a* faces the interior of the lower crank case 5. The oil filter 11, which is cylindrical, is fixed so that an axis thereof extends in the longitudinal direction. The oil filter is fixed at a transverse position where it overlaps the starter motor 10

Figure 3:
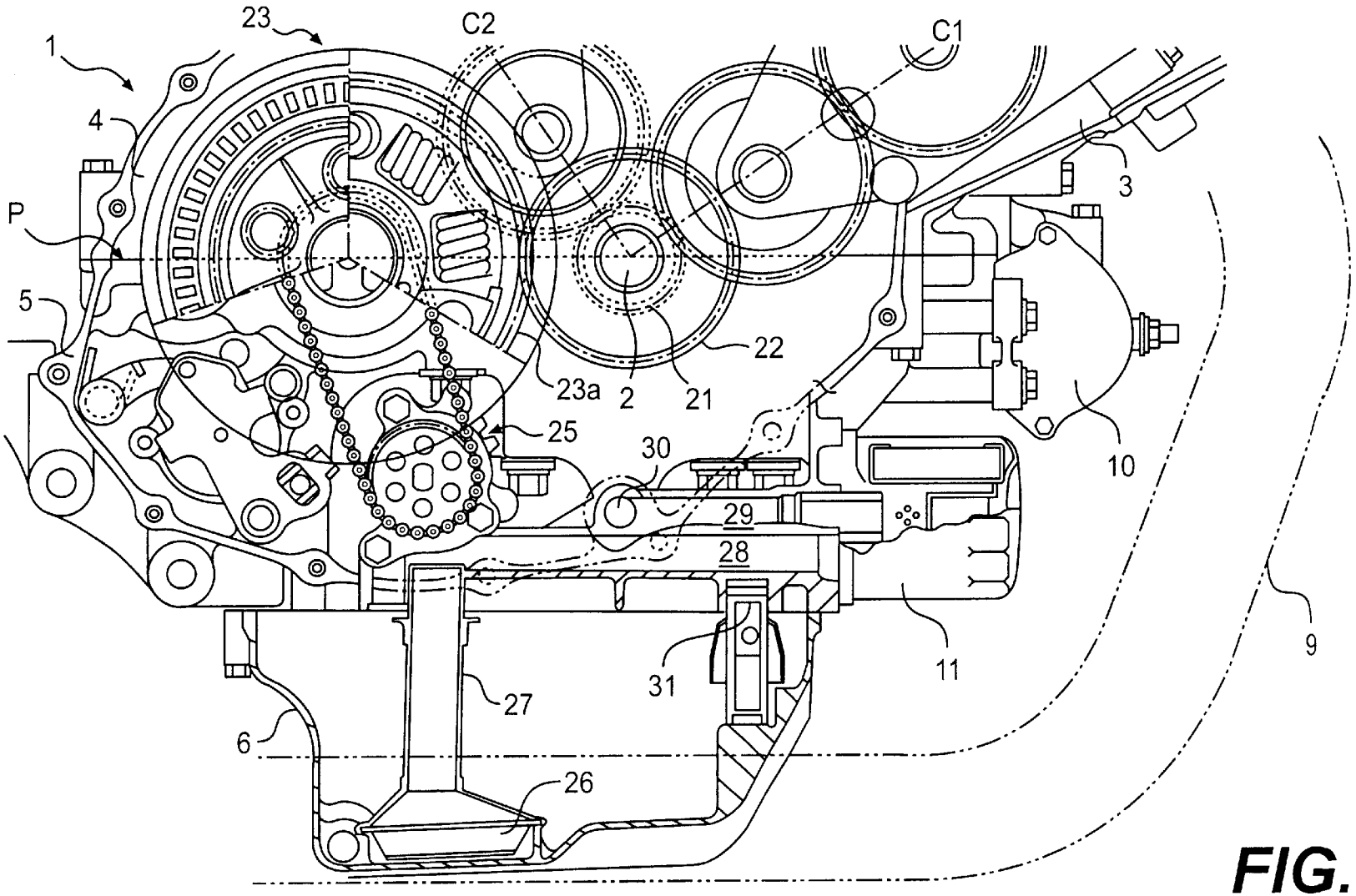
FIG. 3 is a right side view of the engine shown in FIG. 1.

Furthermore, as indicated with a dash-double dot line in FIGS. 1, 3 and 4, an exhaust pipe 9, which is connected to an exhaust port formed in a front face of the front cylinder 3, extends forward and obliquely downward from the exhaust port, then is curved and extends backward and obliquely downward, then is curved into a horizontal state, and extends backward along the right side face of the oil pan 6.

As shown in FIG. 1, which is a left side view of the crank case in the engine 1, an AC generator 20 is fixed to a left end portion of the crank shaft 2. The AC generator 20 is shown with a cover thereof removed. At a position close to the left crank journal 2*a*, which position is an inner position with respect to the AC generator 20, a clutch inner 16*a* of a one-way clutch 16 is mounted on the crank shaft 2 in an adjacent relation to the AC generator 20 and rotatably through a bearing. A starter driven gear 15 is fixed to an outer periphery of the clutch inner 16*a* (see FIG. 2).

On the left-hand side of the crank case are installed a first reduction gear 13 and a second reduction gear 14 both for transmitting the rotation of the pinion gear 12 mounted on the shaft 10*a* of the starter motor 10 to the starter driven gear 15. The pinion gear 12 and the first and second reduction gears 13, 14 constitute a gear train for transmitting the rotation of the starter motor 10 to the crank shaft 2 via the starter driven gear 15. Therefore, the gear train is disposed on the left end side of the crank shaft 2. As to the gear train, a detailed description thereof will be given later.

On the other hand, as shown in FIG. 3, which is a right side view of the crank case in the engine 1, a driving gear 21 and a primary driving gear 22 are splined to the crank shaft 2 at a right end portion of the crank shaft successively rightwards from the right-hand crank journal so as to rotate integrally with the crank shaft. Rotation of the driving gear 21 is transmitted via a series of gears to cam driven gears mounted respectively on an intake cam shaft and an exhaust cam shaft which are provided in a cylinder head mounted to the front cylinder 3. In addition, rotation of the driving gear 21 is transmitted via another series of gears to cam driven gears mounted respectively on an intake cam shaft and an exhaust cam shaft which are provided in a cylinder head mounted to the rear cylinder. The driving gear 21, a series of gears referred to above, and the cam driven gears constitute a cam shaft driving mechanism.

On the right-hand side of the crank case is provided a multiple-disk friction clutch 23 which is mounted on a right end portion of the main shaft in the gear transmission. In FIG. 3, the multiple-disk friction clutch 23 is shown with a cover thereof removed and with a portion of clutch constituent members also removed. The multiple-disk friction clutch 23 has a primary driven gear 23*a* which engages the primary driving gear 22 splined to the crank shaft 2. The rotation of the crank shaft 2 is transmitted from the primary driving gear 22 to a rear wheel via the gear transmission and a driving chain.

On the main shaft portion close to a speed change gear in the gear transmission, which is located at an inner position with respect to the multiple-disk clutch 23, there is mounted a driving sprocket 24 adjacent the clutch 23. The driving sprocket 24, which is for driving an oil pump through a chain, is adapted to rotate integrally with the primary driven gear 23*a*.

An oil pump 25 is secured to the lower crank case 5, and an oil suction pipe 27 is connected at one end thereof to an oil strainer 26 positioned on the bottom of the oil pan 6 and is connected at an opposite end thereof to a suction port of the oil pump 25. A discharge port of the oil pump 25 is connected to one end of a first oil passage 28, which is formed rectilinearly in the lower crank case 5. An opposite end of the first oil passage 28 is connected to an inlet of the oil filter 11. An outlet of the oil filter 11 is connected to one end of a second oil passage 29, which is formed rectilinearly in the lower crank case 5. An opposite end of the second oil passage 29 is connected to a main gallery which is formed in the lower crank case 5.

According to this arrangement, the oil stored in the oil pan 6 passes through the oil strainer 26 and is sucked into the oil pump 25 through the oil suction pipe 27. The oil discharged from the oil pump 25 passes through the first oil passage 28, the oil filter 11 and the second oil passage 29 and enters a main gallery 30, from which the oil is fed to the components to be lubricated such as the crank shaft 2 and cam shafts. A relief valve 31 is installed in the first oil passage 28, whereby surplus oil is recycled to the oil pan 6.

Since the oil filter 11 is attached to the front face of the lower crank case 5, the oil from the oil pump 25 attached to the lower crank case can be fed under pressure to the main gallery 30 through the first and second oil passages 28, 29 which are formed rectilinearly in only the lower crank case 5. Thus, the oil passages 28 and 29 have few curved or bent portions, whereby the passage structure is simplified and the formation thereof is facilitated. Furthermore, unlike the foregoing conventional art, it is unnecessary to form an oil passage for the oil discharged from the oil pump 25 in the oil pan 6. This permits a reduction in size of the oil pan. Consequently, the space for mounting the exhaust pipe 9 along the right side face of the oil pan 6 becomes larger and the degree of freedom in the arrangement of the exhaust pipe 9 increases.

Figure 2:
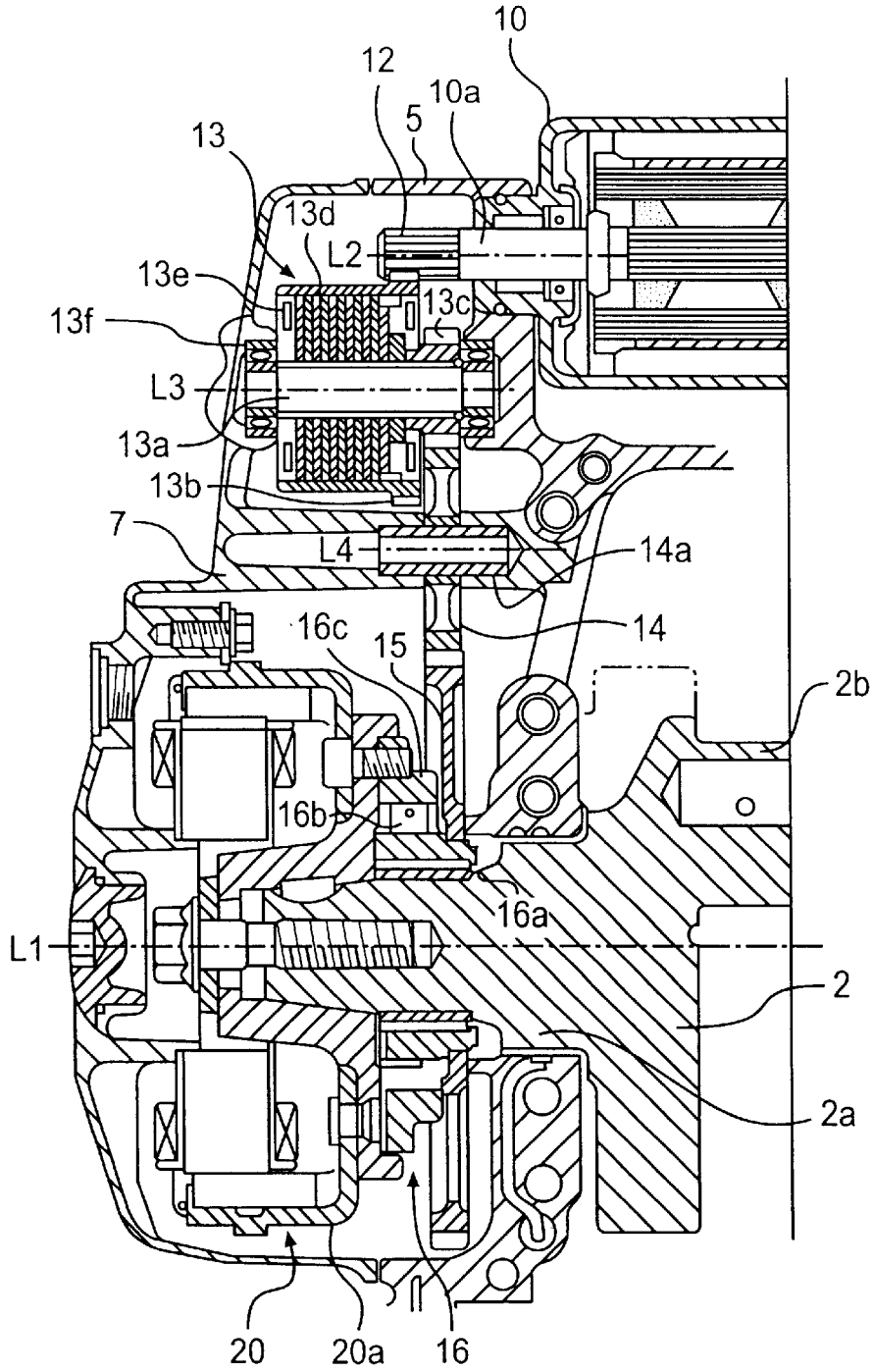
FIG. 2 is a sectional view taken on line II—II in FIG. 1.

The gear train will now be described below with reference to FIGS. 1 and 2. As noted previously, the gear train is made up of pinion gear 12, first reduction gear 13 and second reduction gear 14. The first reduction gear 13 incorporates a torque limiter therein. Furthermore, as shown in FIG. 2, the first reduction gear 13 is provided with a large-diameter gear portion 13*b* and a small-diameter gear portion 13*c*. The large-diameter gear portion 13*b* is formed on an outer periphery of a cylindrical outer member 13*d* and is in mesh with the pinion gear 12.

A plurality of friction disks 13*e* are disposed on an inner periphery side of the outer member 13*d*. A plurality of pawls are formed circumferentially on an outer periphery of each of the friction disks 13*e* and are fitted in a plurality of grooves formed circumferentially on the inner periphery of the outer member 13*d*. The grooves extend axially on the outer member, so that the friction disks 13*e* are adapted to rotate integrally with the outer member 13*d*. On the other hand, a plurality of friction plates 13*f* are disposed on an outer periphery of a gear shaft 13*a* in an alternately superimposed relation to the friction disks 13*e*. A plurality of pawls are formed circumferentially on an inner periphery of each friction plate 13*f* and are fitted in a plurality of grooves formed circumferentially in the outer periphery of the gear shaft 13*a* and extending axially of the gear shaft, whereby the friction plates 13*f* rotate integrally with the gear shaft 13*a*.

One end portion of the gear shaft 13*a* and an opposite end portion thereof are supported respectively by the lower crank case 5 and the crank case cover 7 through bearings. The small-diameter gear portion 13*c* is splined to the outer periphery of the gear shaft 13*a* so as to rotate integrally with the gear shaft 13*a*.

The friction disks 13*e* and the friction plates 13*f* are biased with springs so that a friction force is exerted between them. On the basis of the friction force, there is induced a torque which permits both friction disks 13*e* and friction plates 13*f* to rotate integrally without slipping. Therefore, upon operation of the starter motor 10 and when the torque acting on the starter motor 10 is not higher than the above preset torque value, both friction disks 13*e* and friction plates 13*f* rotate integrally with each other, with the result that the outer member 13*d* and the gear shaft 13*a* rotate together and the rotation of the starter motor 10 is transmitted to the small-diameter gear portion 13*c* via friction disks 13*e*, friction plates 13*f* and gear shaft 13*a*. When the torque acting on the starter motor 10 is larger than the preset torque value, slipping occurs between the friction disks 13*e* and the friction plates 13*f* to prevent overloading from being imposed on the starter motor 10.

The second reduction gear 14, which is mounted rotatably on a gear shaft 14*a*, is in mesh with both the small-diameter gear portion 13*c* and the starter driven gear 15. One end portion of the gear shaft 14*a* is supported by the upper crank case 4 and an opposite end portion thereof is supported by the crank case cover 7.

The one-way clutch 16, which permits the transfer of rotation from the starter motor 10 to the crank shaft 2 and which blocks the transfer of rotation from the crank shaft 2 to the starter motor 10, includes the clutch inner 16*a* onto which the starter driven gear 15 is fixed, as noted previously, and which is mounted on the crank shaft 2 rotatably through a bearing Furthermore, the one-way clutch 16 includes a clutch body 16*b* which is fitted on the outer periphery of the clutch inner 16*a* and in which are incorporated a roller and a coiled spring for biasing the roller, and a clutch outer 16*c* which is fitted on an outer periphery of the clutch body 16*b* and which is fixed to a flywheel 20*a* of the AC generator 20.

In the gear train of such a configuration, the rotation of the starter motor 10 is transmitted to the crank shaft 2 via pinion gear 12, first reduction gear 13, second reduction gear 14, starter driven gear 15, one-way clutch 16, and AC generator 20

As shown in FIG. 1, a gear shaft axis L4 of the second reduction gear as a constituent of the gear train is disposed on a side of the dividing plane P as a plane including the crank shaft 2 on which side the cylinder axis C1 of the front cylinder 3 is positioned, that is, above the dividing plane P. The cylinder axis C1 of the front cylinder 3 is inclined forward, in other words, an included angle between a planar portion of the dividing plane P extending from the crank shaft axis L1 toward the gear train and the cylinder axis C1 of the front cylinder 3 is an acute angle.

Thus, a cam shaft driving mechanism extending from the crank shaft 2 to the cylinder head of the front cylinder 3 is not disposed on the left end side of the crank shaft. Therefore, even if the front cylinder 3 is inclined to the dividing plane P side, no interference occurs between the gear train and the cam shaft driving mechanism, thus permitting the second reduction cam to be disposed in proximity to the front cylinder 3 above the dividing plane P. Consequently, the remaining gears as constituents of the gear train can be disposed at an upper position in the lower crank case 5 As a result, the starter motor 10 can be disposed at an upper position of the front face of the lower crank case 5, and the oil filter 11 can be installed in the space formed below the starter motor.

Figure 5:
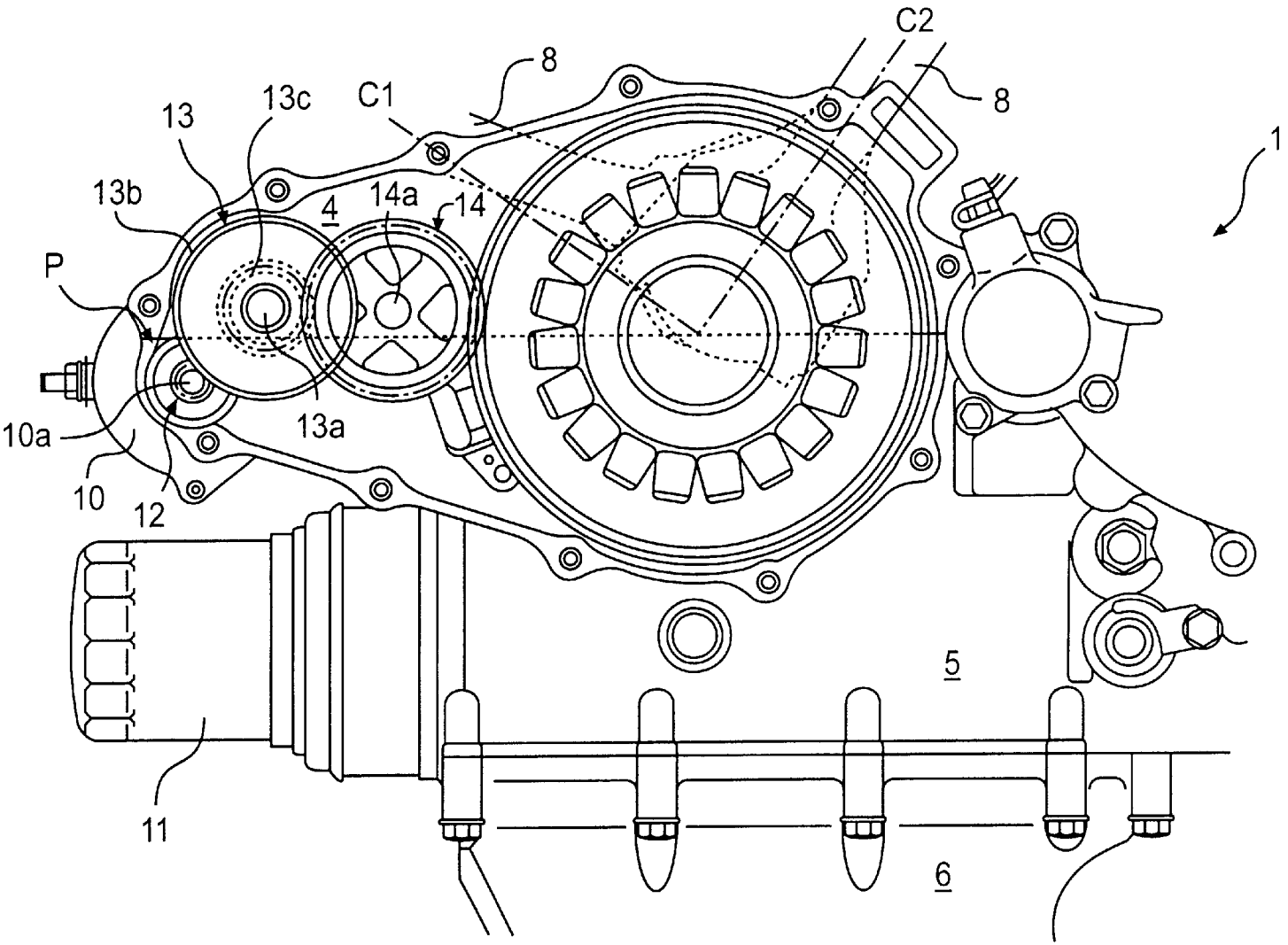
FIG. 5 is a left side view of the engine shown in FIG. 1, having a gear train of another arrangement.
Figure 6:
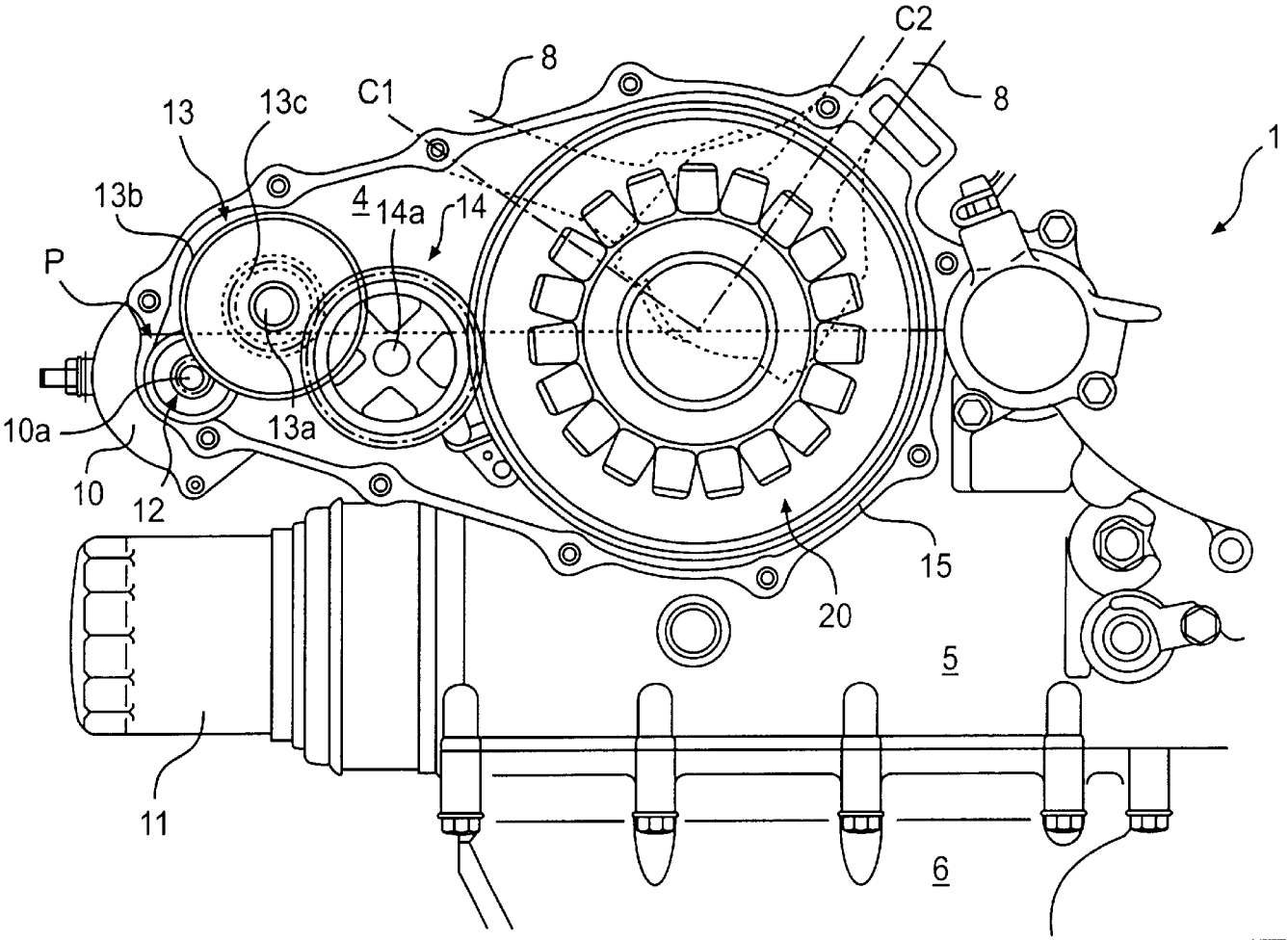
FIG. 6 is a left side view of the engine shown in FIG. 1, having a gear train of still another arrangement.
Figure 7:
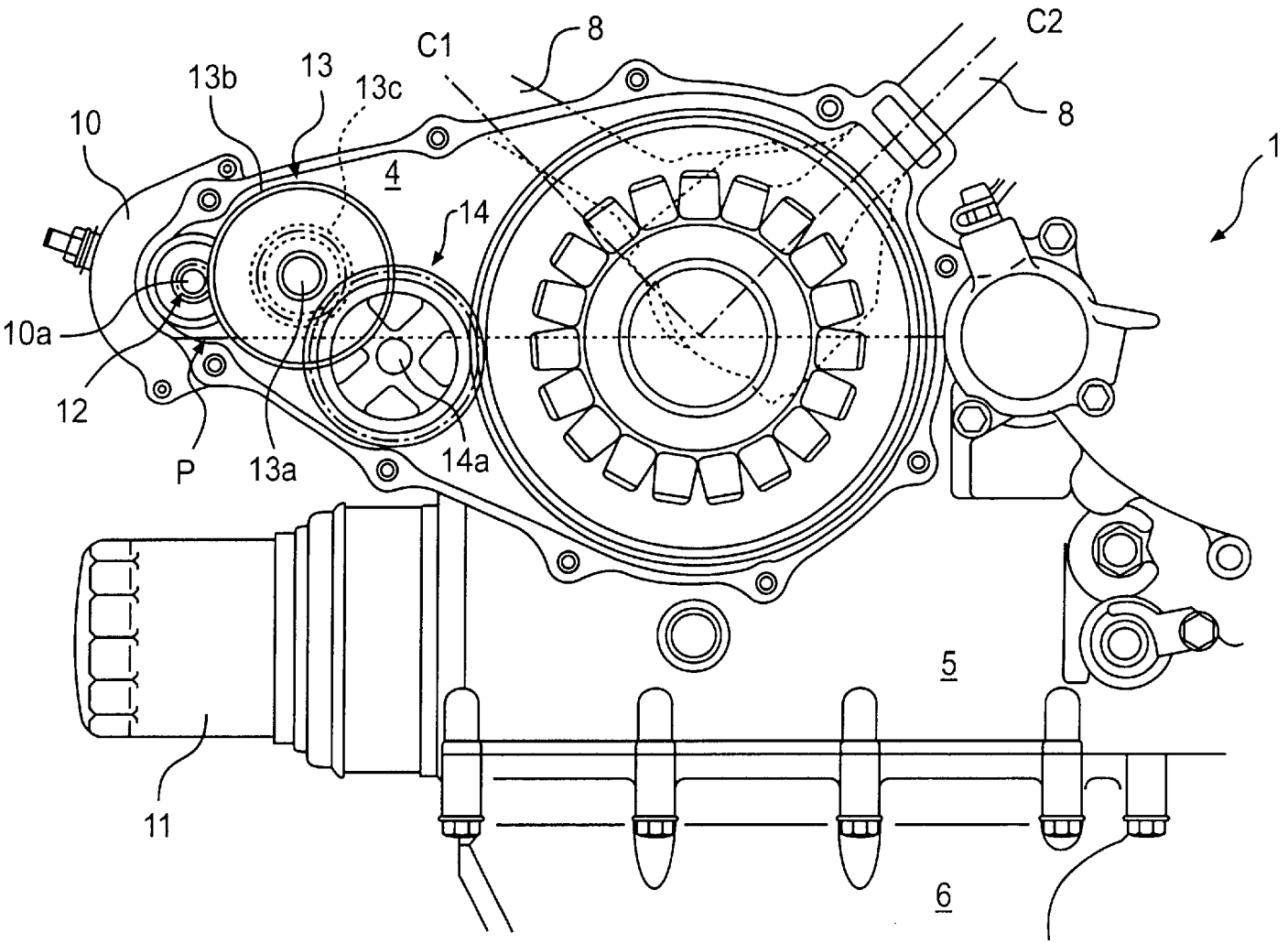
FIG. 7 is a left side view of the engine shown in FIG. 1, having a gear train of still another arrangement.

In the gear train, the axis L2 of the shaft 10*a* of the starter motor 10 corresponding to the gear shaft of the pinion gear 12 and a gear shaft axis L3 of the first reduction gear 13 are positioned below the dividing plane P. The gear shaft axis L4 of the second reduction gear 14 is positioned above the dividing plane P. However, there also may be adopted such gear train arrangements as illustrated in FIGS. 5 to 7.

In the gear train illustrated in FIG. 5, an axis L2 of the shaft 10*a* (the shaft of the pinion gear 12) of the starter motor 10 is positioned below the dividing plane L2, while the gear shaft axis L3 of the first reduction gear 13 and the gear shaft axis L4 of the second reduction gear 14 are positioned above the dividing plane P.

In the gear train illustrated in FIG. 6, the axis L2 of the shaft 10*a* ( the shaft of the pinion gear 12) of the starter motor 10 and the axis L4 of the second reduction gear 14 are positioned below the dividing plane P, and the axis L3 of the first reduction gear 13 is positioned above the dividing plane P.

In the gear train illustrated in FIG. 7, the gear shaft axis L4 of the second reduction gear 14 is positioned below the dividing plane P, and the axis L2 of the shaft 10*a* (the shaft of the pinion gear 12) of the starter motor 10 and the gear shaft axis L3 of the first reduction gear 13 are positioned below the dividing plane P. In this example, the included angle between the planar portion of the dividing plane and the axis C1 of the front cylinder 3 is set larger than in the previous examples. Consequently, the starter motor 10 is mounted to the front face of the upper crank case 4.

A suitable arrangement of the gear train is determined taking into account the magnitude of the included angle between the planar portion of the dividing plane and the cylinder axis C1 and the relationship between the gears 12, 13 and 14 which constitute the gear train and the components arranged around those gears.

Since this embodiment is constructed as above, there are attained the following effects.

In the V-type 2-cylinder engine having a width in the crank shaft axis direction which is narrow, the starter motor 10 is attached to the front face of the crank case and the included angle between the planar portion of the dividing plane extending from the crank shaft axis L1 toward the gear train and the axis C1 of the front cylinder 3 is an acute angle. therefore, despite the front cylinder 3 being positioned close to the starter motor 10, the gear train is disposed on the left end side of the crank shaft 2 opposite to the right end side of the crank shaft where the cam shaft driving mechanism is disposed.

Therefore, without interference with the driving gear 21 in the cam shaft driving mechanism and a series of gears, the axis L3 of the first reduction gear 13 and/or the axis L4 of the second reduction gear 14, which gears are included among the plural constituent gears of the gear train, can be positioned in the upper crank case above the dividing plane P. In addition, the gear shaft axis L2 of the pinion gear 12 which is also one of the plural constituent gears of the gear train can be positioned in the upper crank case 4 above the dividing plane P.

Therefore, the starter motor 10 can be mounted to the front face of the lower crank case 5 in proximity to the upper crank case 4 or can be mounted to the front face of the upper crank case 4. As a result, it becomes possible to mount the starter motor 10 to the front face of the crank case in proximity to the front cylinder 3. Since the starter motor 10 thus approaches the front cylinder 3, a space is created on the front face of the lower crank case 5 and it can be utilized as a mounting space for the oil filter 11.

Furthermore, since the plural gears 12, 13 and 14 which constitute the gear train can be arranged dispersed in the upper and lower crank cases 4, 5 on both sides of the dividing plane P, the gear train can be disposed without enlarging the spacing between the starter motor 10 and the crank shaft 2, whereby the crank case can be made compact.

Since the starter motor 10 and the oil filter 11 are attached to the front face of the lower crank case 5 to which the oil pump 25 is mounted, it is possible to feed oil under pressure from the oil pump 25 to the oil filter 11 and the main gallery 30 via the oil passages 28 and 29 which are formed rectilinearly in only the lower crank case 5. Consequently, the oil passage structure is simplified and the formation thereof becomes easier, thus leading to a reduction of cost. Furthermore, it is possible to reduce the size of the oil pan 6 because the formation of an oil passage in the oil pan 6 as in the conventional art is not needed.

Since the oil filter 11 is mounted in the space formed on the front face of the crank case 5 at a position below the starter motor 10, the oil filter does not project from the front face of the oil pan 6 unlike the conventional art. Therefore, by utilizing the resulting space around the oil pan 6 and the space created by the reduction in size of the oil pan, the degree of freedom in the arrangement of the exhaust pipe 9 which has heretofore been disposed around the oil filter attached to the oil pan increases. For example, it becomes possible to effect a more compact arrangement or an arrangement based mainly on performance.

Although in the above embodiment the plane including the crank shaft axis L1 corresponds to the crank case dividing plane P, it may be a plane including the crank shaft axis L1 other than the dividing plane P.

Although in the above embodiment the axis of only a portion of the pinion gear 12, first reduction gear 13 and second reduction gear 14 is disposed above the dividing plane P, the gear shaft axes L2, L3 and L4 of all the gears 12, 13 and 14 which constitute the gear train may be positioned above the dividing plane P.

Although in the above embodiment there are used two reduction gears 13 and 14, the number of reduction gears to be used may be one or three or more. Furthermore, it is not always required for the reduction gears to incorporate a torque limiter therein.

Although in the above embodiment a series of gears are used for driving the cam shaft driving mechanism, there may be used a chain stretched between and entrained on the crank shaft 2 and the cam shafts.

Although in the above embodiment the engine 1 is a 2-cylinder engine, it may be a single-cylinder or 3- or more-cylinder engine. Insofar as the engine is a 2- or more-cylinder engine, the type of engine is not limited to V-type, but it may be any other type. The engine 1 may be mounted on any other vehicle other than a motorcycle, or it may be mounted on any other thing other than vehicles.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An overhead cam shaft engine, comprising:

a cylinder;

a cylinder head mounted to said cylinder;

a cam shaft provided in said cylinder head;

a crank shaft;

a cam shaft driving mechanism disposed on a first end of said crank shaft for transmitting rotation of said crank shaft of the engine to said cam shaft;

a crank case;

a starter motor attached to a surface of said crank case;

a gear train disposed on a second, opposite end of said crank shaft for transmitting rotation of said starter motor to the crank shaft, said gear train including a plurality of gears, a gear shaft axis of at least one of said plurality of gears is disposed on a same side of a plane including an axis of said crank shaft as an axis of said cylinder, and an included angle between a planar portion extending toward said gear train from said crank shaft axis in said plane and said cylinder axis is an acute angle; and wherein said crank case is divided vertically into an upper crank case and a lower crank case by a dividing plane, said crank shaft is supported by said upper crank case and said lower crank case, said plane including the crank shaft axis is said dividing plane, at least one gear shaft axis of a portion of said plurality of gears is disposed on an upper side of said dividing plane, at least one gear shaft axis of the remaining of said plurality of gears is disposed on a lower side of the dividing plane, and an axis of said cylinder is positioned on said upper side.

2. The overhead cam shaft engine according to claim 1, wherein an oil filter is attached to a surface of the crank case at a position below said starter motor.

3. The overhead cam shaft engine according to claim 2, wherein an oil pan is attached to a lower portion of said lower crank case, an oil pump is attached to the lower crank case, and said starter motor and said oil filter are attached to a surface of the lower crank case.

4. The overhead cam shaft engine according to claim 3, wherein an exhaust pipe connected to said cylinder is arranged along a side face of said oil pan.

5. The overhead cam shaft engine according to claim 4, wherein said engine is a V2-cylinder engine for being installed horizontally on a vehicle, and said cylinder belongs to a front bank.

6. The overhead cam shaft engine according to claim 3, wherein said engine is a V2-cylinder engine for being installed horizontally on a vehicle, and said cylinder belongs to a front bank.

7. The overhead cam shaft engine according to claim 2, wherein said engine is a V2-cylinder engine for being installed horizontally on a vehicle, and said cylinder belongs to a front bank.

8. The overhead cam shaft type engine according to claim 1, wherein said engine is a V2-cylinder engine for being installed horizontally on a vehicle, and said cylinder belongs to a front bank.

9. A starter motor mounting arrangement for an overhead cam shaft engine, comprising:

a crank case;

a crank shaft;

a starter motor attached to a surface of said crank case;

a gear train disposed on an end of said crank shaft for transmitting rotation of said starter motor to the crank shaft, said gear train including a plurality of gears, a gear shaft axis of at least one of said plurality of gears is disposed on a same side of a plane including an axis of said crank shaft as an axis of a cylinder of said engine, and an included angle between a planar portion extending toward said gear train from said crank shaft axis in said plane and said cylinder axis is an acute angle; and wherein said crank case is divided vertically into an upper crank case and a lower crank case by a dividing plane, said crank shaft is supported by said upper crank case and said lower crank case, said plane including the crank shaft axis is said dividing plane, at least one gear shaft axis of a portion of said plurality of gears is disposed on an upper side of said dividing plane, at least one gear shaft axis of the remaining of said plurality of gears is disposed on a lower side of the dividing plane, and an axis of said cylinder is positioned on said upper side.

10. The starter motor mounting arrangement according to claim 9, wherein an oil filter is attached to a surface of the crank case at a position below said starter motor.

11. The starter motor mounting arrangement according to claim 10, wherein an oil pan is attached to a lower portion of said lower crank case, an oil pump is attached to the lower crank case, and said starter motor and said oil filter are attached to a surface of the lower crank case.

12. The starter motor mounting arrangement according to claim 11, wherein an exhaust pipe connected to said cylinder is arranged along a side face of said oil pan.

* * * * *